United States Patent [19]

Black

[11] Patent Number: 4,603,735

[45] Date of Patent: Aug. 5, 1986

[54] DOWN THE HOLE REVERSE UP FLOW JET PUMP

[75] Inventor: John B. Black, Longview, Tex.

[73] Assignee: New Pro Technology, Inc., Fort Worth, Tex.

[21] Appl. No.: 661,937

[22] Filed: Oct. 17, 1984

[51] Int. Cl.[4] ..... E21B 43/00

[52] U.S. Cl. ..... 166/68; 166/105; 166/372; 417/172

[58] Field of Search ..... 166/68, 68.5, 105, 106, 166/372; 417/172

[56] References Cited

U.S. PATENT DOCUMENTS

| | | | |
|---|---|---|---|
| 1,258,418 | 3/1918 | Kemble | 417/172 |
| 1,693,101 | 11/1928 | Worthington | 417/172 |
| 1,758,376 | 5/1930 | Sawyer | 166/68 |
| 2,080,623 | 5/1937 | McMahon | 417/172 |
| 2,114,905 | 4/1938 | McMahon | 417/172 |
| 2,291,911 | 8/1942 | McMahon | 417/172 |
| 4,223,724 | 9/1980 | Levoni et al. | 166/68 |
| 4,505,646 | 3/1985 | Long et al. | 417/172 |

*Primary Examiner*—Stephen J. Novosad

*Assistant Examiner*—William P. Neuder

*Attorney, Agent, or Firm*—Warren H. Kintzinger

[57] ABSTRACT

A reverse up flow jet pump used in an oil and gas pumping system having a positive displacement pump on the surface supplying water flow under pressure to the jet pump down the hole. The jet pump is used in a system drawing a vacuum reducing if not eliminating the effect of head pressure within the well resulting in freer fluid flow from the formation pay zone to thereby reduce costs and increase production. Water is fed downward through an innermost pipe to a plurality of water flow diverting lines just above the jet pump body directing the water flow to and through a plurality of water flow openings extended through the jet pump body from top to bottom and at the bottom to a water flow reversing cap that reverses the water flow and directs the water flow back up a central opening narrowing for accelerated water flow into and through a venturi chamber having a venturi inlet side vent for vacuum effect drawing well fluids and/or gases from the well casing and the formation into the water flow stream for passage from the jet pump body to and up larger tubing concentric with and enclosing the innermost pipe.

30 Claims, 7 Drawing Figures

DOWN THE HOLE REVERSE UP FLOW JET PUMP

Figure 1:
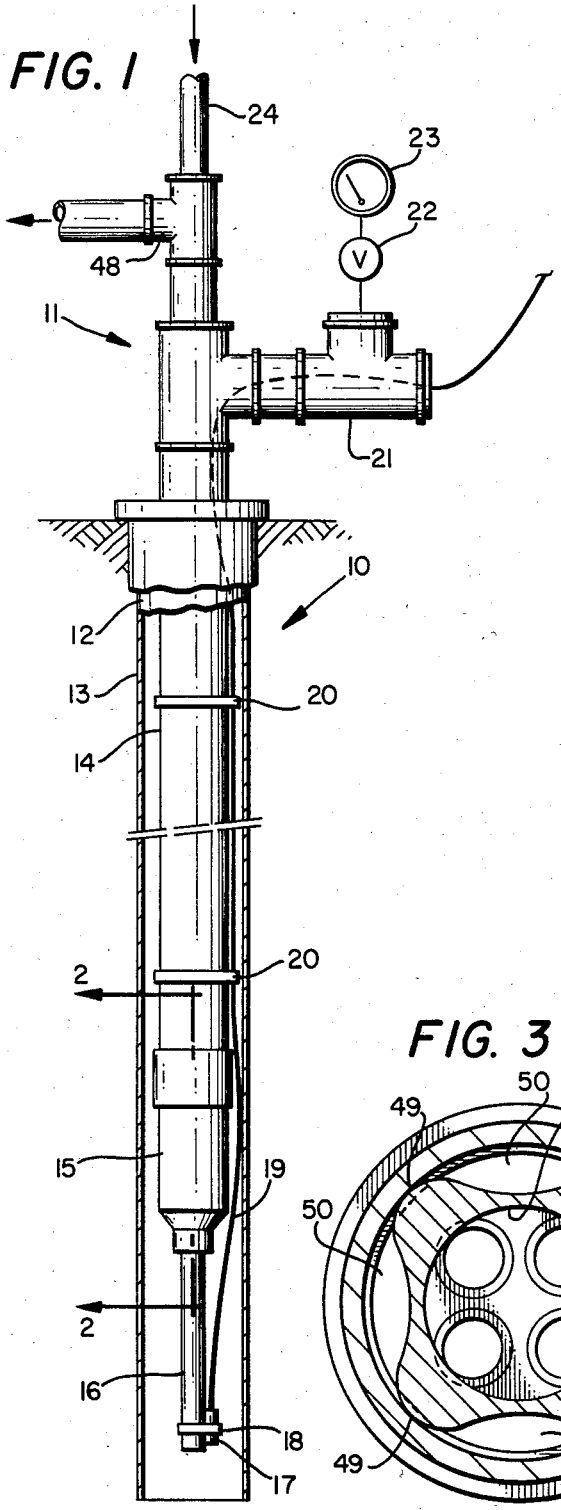

This invention relates in general to the pumping of fluids and/or gases from wells such as oil and gas wells, and more particularly to a reverse up flow jet pump used down the hole in wells and the pumping system used with the jet pump.

Pump jacks, sucker rod strings and down the hole reciprocating pumps of various designs have been used in the oil patch for many years. With this old tried and proven approach there are still problems such as the reflected effect on the producing formation of cyclic on-off suction with the reciprocating action of such pumps. The old tried and true pump jack is a fairly massive piece of equipment required at each well head with such a pumping system. Further, the sucker rod string extending from the pump jack down the well to the down the hole reciprocating pump is fairly expensive and must be adequately strong to avoid breakage in the well and subsequent line fishing required to recover the broken sucker rod string. Another requirement with such reciprocating pump drive sucker rod strings is that they be tuned to the pump stroke length and length of the sucker rod string consistent with the drive imparted by the pump jack. Such problems and considerations are avoided through use of applicants new improved fluid reverse up flow jet pump used down the hole with a pump recirculating water system. They new system also avoids wear between relatively moving parts such as between a sucker rod string and well tubing walls and occasional failure of such members. Further, reciprocating down the hold pumps are replaced by a reverse up flow jet pump that generally has longer service life and does not have to be drawn up from the well serviced and replaced as often as is the case with down the hole reciprocating pumps. Still further, it has been shown that if a steady drawing vacuum is imposed in a well casing and on a pay zone of an oil and/or gas well during periods of pumping with lessened or elminated well head pressure production of oil and/or gas can be significantly increased.

It is therefore a principal object of this invention to increase production of wells through use of a new pumping system using a down the hole reverse up flow jet pump.

Another object is to lower maintenance requirements and operational costs through use of such a down the hole reverse up flow jet pump.

A further object is to lower the per well hole original equipment costs particularly in an oil field with a plurality of wells.

Still another object is to avoid pressure build up in the well and, generally, to avoid introduction of water into the well formation.

Another object is to reduce or eliminate head pressure in the well to optimize product flow from well formation pay zones.

Features of the invention useful in accomplishing the above objects include, in a down the hole reverse up flow jet pump used in an oil or gas well pumping system, a water pump on the surface capable of supplying water flow under pressure to a jet pump down the hole of one or more than one well in a system with the separator separating oil to oil storage and circulation water to a water tank in the water circulation system and gas take off if gas is being produced from the well. The jet pump is used in a system drawing a vacuum reducing if not eliminating the effect of head pressure within the well resulting in freer fluid flow from the formation pay zone to thereby reduce costs and increase production. Water is fed downward through an innermost pipe to a plurality of water flow diverting lines just above the jet pump body directing the water flow to and through a plurality of water flow openings extended through the jet pump body from top to bottom and at the bottom to a water flow reversing cap that reverses the water flow and directs the water flow back up a central opening narrowing for accelerated water flow into and through a venturi chamber having a venturi inlet side vent for vacuum effect drawing well fluids and/or gases from the well casing and the formation into the water flow stream for passage from the jet pump to and up larger tubing concentric with and enclosing the innermost pipe. In one embodiment the venturi inlet side vent includes a check valve permitting vacuum effect drawing of well fluids and/or gases directly from the well casing at one side thereof. In another embodiment the inlet side vent draws from a chamber surrounding the lower portion of the jet pump and extending below the bottom of the jet pump body and with the chamber including a check valve at the bottom thereof for the drawing of well fluids and/or gases from the well casing when the pump is pumping and closing to limit head pressure from the well casing when the jet pump is not pumping.

Specific embodiments representing what are presently regarded as the best modes of carrying out the invention are illustrated in the accompanying drawings.

Figure 2:
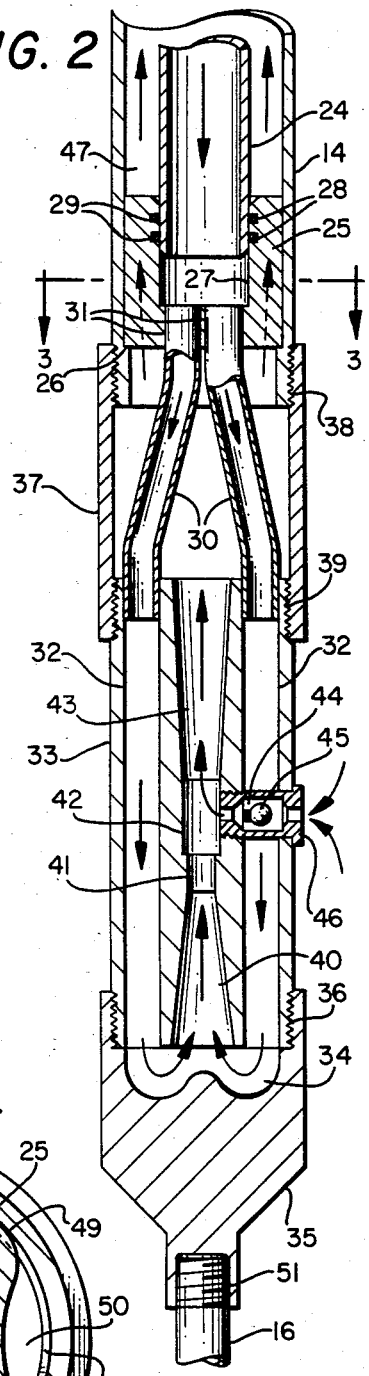
Figure 3:
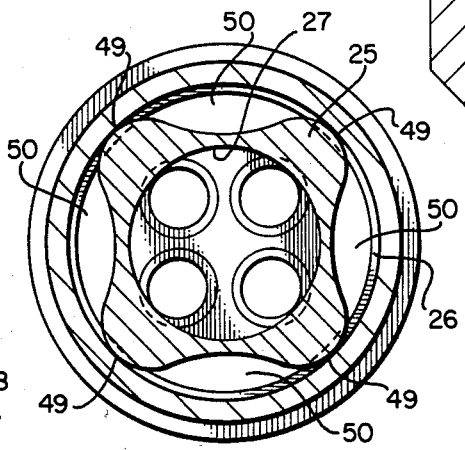
Figure 5:
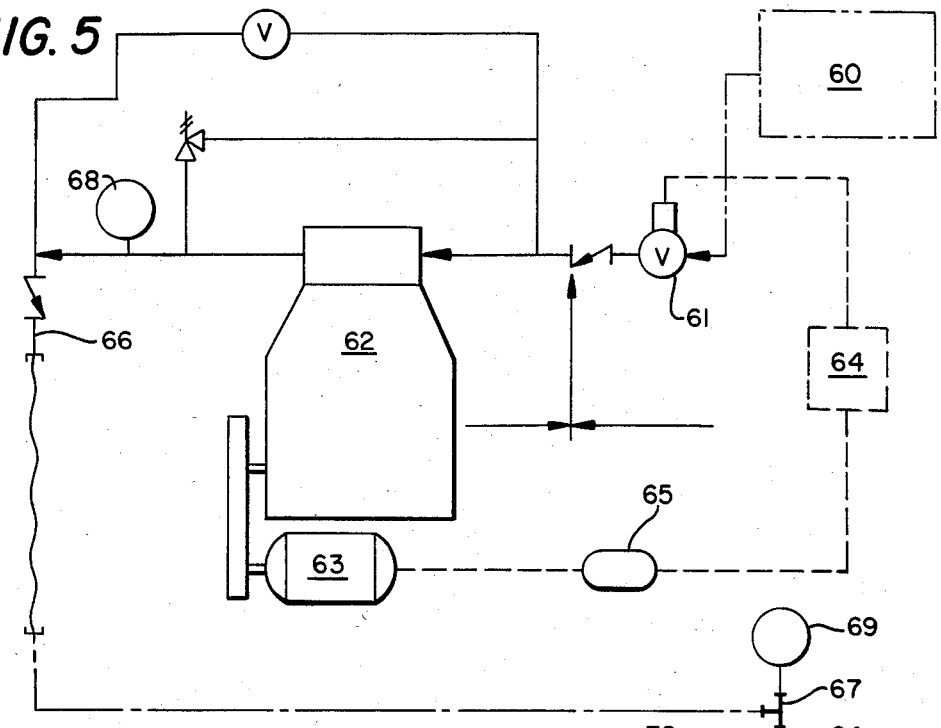
Figure 4:
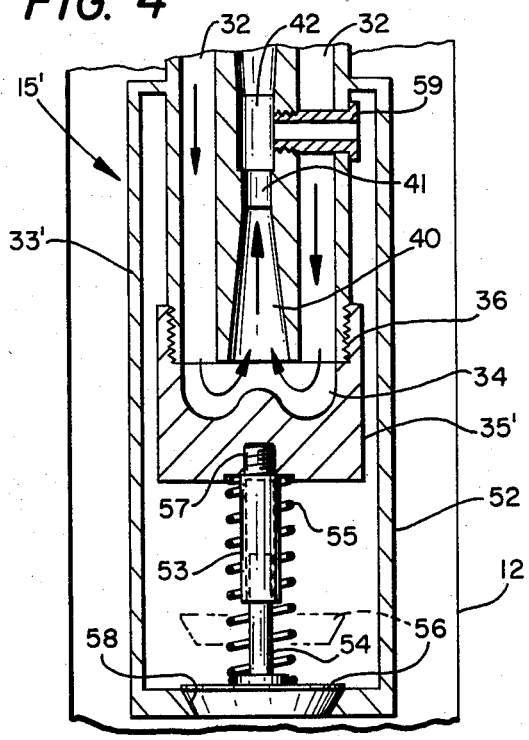
Figure 4:
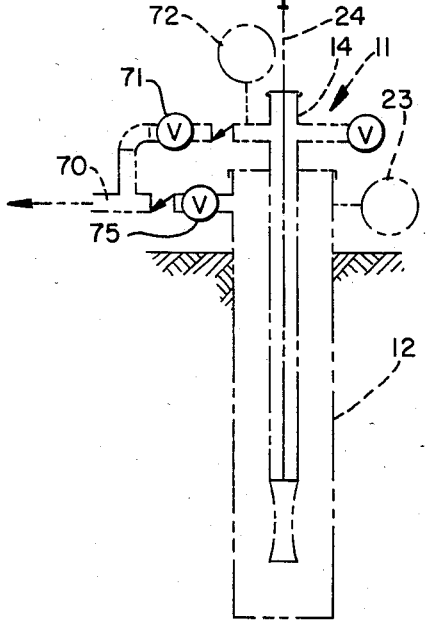
Figure 6:
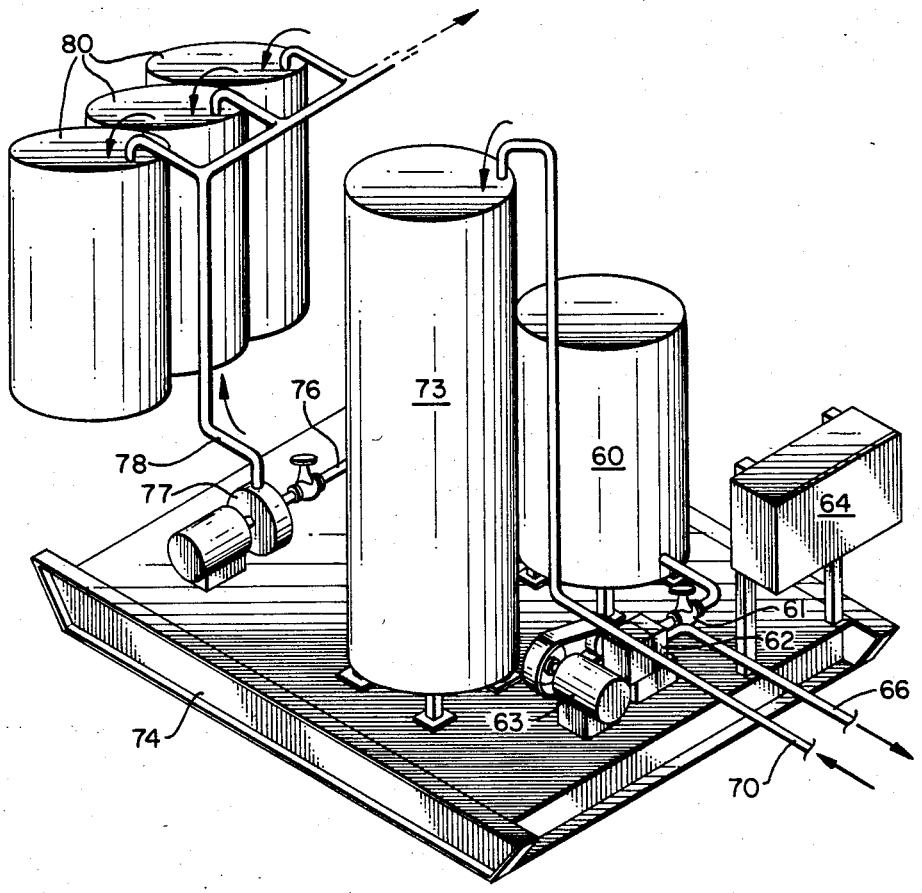
Figure 7:
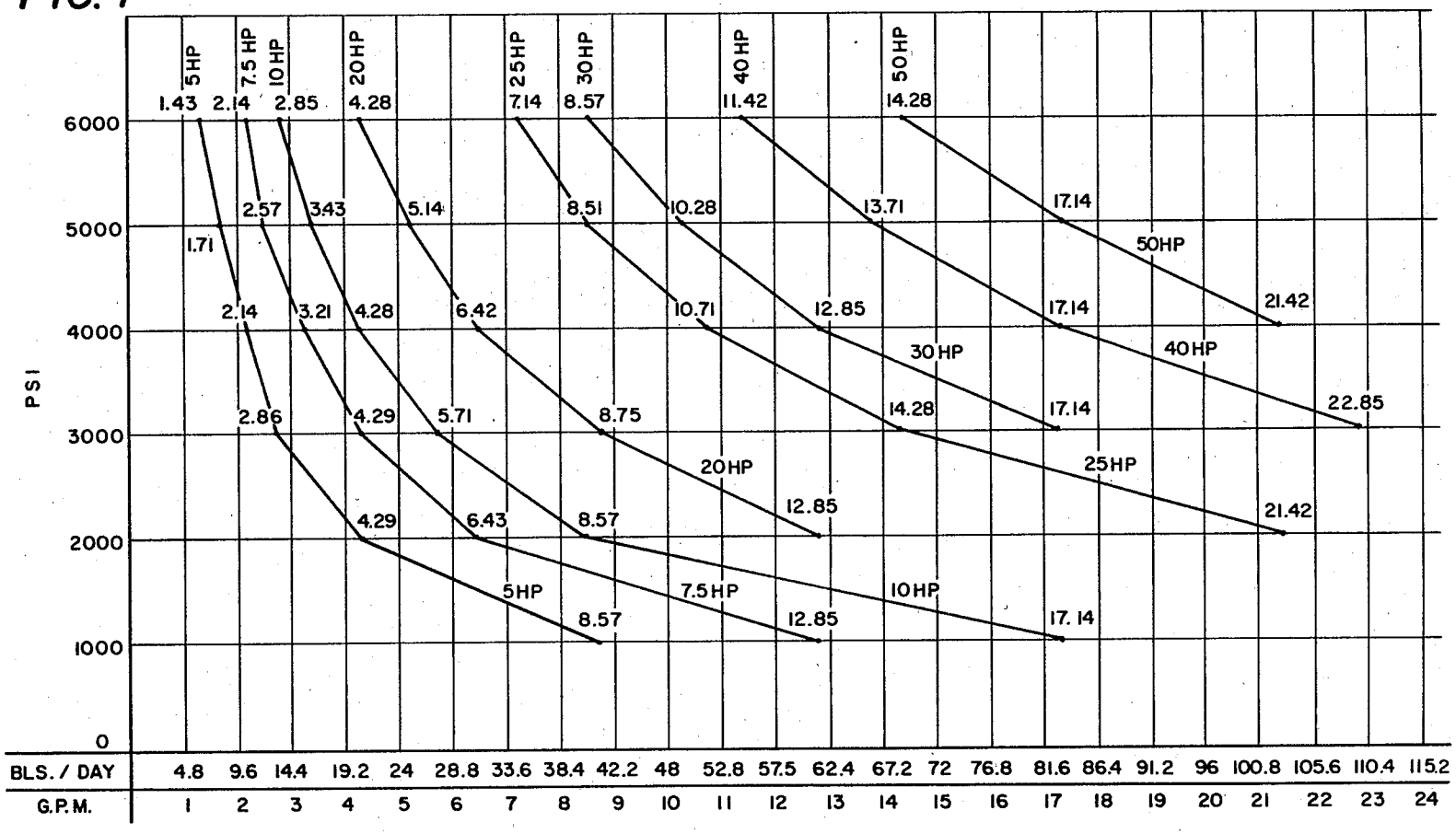

In the drawings:

FIG. 1 represents a side elevation view of an oil and/or gas well with a down the hole reverse up flow jet pump in place in the well along with a pressure sensor and a christmas tree at the surface with pipe, tubing and casing connections;

FIG. 2, a cut away and sectioned view taken generally along line 2—2 of FIG. 1 showing internal detail of a reverse up flow jet pump with connection to pipe and tubing down the hole;

FIG. 3, a cut away and sectioned view taken along line 3—3 of FIG. 2 showing additional detail of circulation fluid passages with the jet pump of FIG. 2;

FIG. 4, a partial cut away and sectioned view like FIG. 2 of another reverse up flow jet pump embodiment with a chamber surrounding the lower portion of the jet pump and extending below the bottom of the jet pump body including a check valve at the chamber bottom;

FIG. 5, a partial schematic showing of the jet pump pumping water circulation system;

FIG. 6, a pallet mounted surface water pump, oil and/or gas and water separator, oil pump and control box; and FIG. 7, a pump water pressure, rate of flow and horsepower plot graph based on 100% efficiency.

Referring to the drawings:

The oil and gas well 10 of FIG. 1 is shown to extend down from a christmas tree 11 with a tubular casing 12 set in place in a drilled hole 13 in the earth. A tube 14 extends down from the christmas tree 11 to mount on its bottom a reverse up flow jet pump 15 as a down the hole pump with a stringer extension 16 from the bottom thereof with a pressure sensor 17 mounted thereon with a strap 18. A signal line 19 extends up within the well casing 12 supported by spaced straps 20 on the outside of tube 14 to exit from the christmas tree 11 through casing connection fitting 21 that is provided with a valve 22 and gauge 23 for measuring casing 12 pressure. A water pressure flow pipe 24 enters the christmas tree 11 from the top and extends down the well casing 12 within tube 14 to the top of the reverse up flow jet pump 15. The tube 14 is larger than and encloses pipe 24 throughout its extension from the christmas tree 11 down to the top of the reverse up flow jet pump 15.

Referring also to FIGS. 2 and 3, a two way water flow block 25 is supported in the bottom end of the bottom section of tube 14 held therein by shoulder 26. Block 25 has a center opening 27 open to the top that receives the bottom end of water pressure flow pipe 24 with "O" rings 28 in grooves 29 sealing pipe 24 from bypass leakage to the water and well product up flow. Water flow under pressure is passed to a plurality (four in this instance) of water flow diverting line tubes 30 with upper ends held in opening 31 in the bottom of two way water flow block 25, and open to center opening 27. The bottoms of water flow diverting line tubes 30 are received in the top of water flow openings 32 (four in this instance) extended through from top to bottom of the jet pump body 33 to a water flow reversing chamber 34 in water flow reversing cap 35 that is threaded 36 to the bottom of cylindrical jet pump body 33. Tubular coupling 37 interconnecting tube 14 and jet pump body 33 and generally enclosing water and well product flow space containing water flow diverting line tubes 30 is threaded 38 to the bottom of tube 14 and threaded 39 to the top of jet pump body 33. The water flow reversing chamber 34 in water flow reversing cap 35 is shaped to efficiently reverse the down flow of water under pressure issuing from the bottom of the four water flow openings 32 and direct the water flow converging inward to and up a center opening 40 open to the bottom of jet pump body 33. Center opening 40 is in the form of a truncated cone narrowing from bottom to top to a short relatively small diameter passage opening 41 for accelerated water flow into and through a venturi chamber 42 of larger diameter and longer than the relatively short passage opening 41. There above an inverted truncated cone opening 43 extends from venturi chamber 42 in jet pump body 33 to the top thereof dumping upflow of circulation water and product drawn into the well and into the pump venturi chamber 42 by the steady venturi suction action of the jet pump 15. The product of the well is drawn through a spring 44 loaded ball 45 check valve 46 that extends from the exterior of jet pump body 33 to the side of venturi chamber 42.

The circulation pumping water with well product (oil and/or gas) entrained therein dumped from the top of conical opening 43 passes in upward flow through the space within tubular coupling 37 around the outside of water flow diverting line tubes 30. The pumping water with product entrained therein then passes by two way water flow block 25 to the annular space 47 between pipe 24 and tube 14 and on up the well in tube 14 through the annular space in tube 14 to pass out through fitting 48 on christmas tree 11 to a separator and storage of recirculation water and oil and/or gas storage. Two way water flow block 25 is a vertically lobed 49 block to present lobe support projections resting on tube shoulder 26 with flow channels 50 between lobes 49 permitting the upward flow of pump water with entrained product to pass by block 25. Please note that the stringer extension 16 is threaded 51 into the bottom of water flow reversing cap 35. Pressure sensed by pressure sensor 17 and signal transmitter through signal line 19 is useful in indicating when well product pressure is suitable for renewed pumping cycles and may be used as a control input to a control system for periodically initiating pumping of the well.

With the alternate reverse up flow jet pump 15' embodiment of FIG. 4 only the lower portion is shown, since the upper portion is substantially the same as with the jet pump 15 of FIGS. 2 and 3 and members the same are numbered the same and those portions similar or substantially the same are given primed numbers as a matter of convenience. With this embodiment a chamber enclosure 52 surrounds the lower portion of the jet pump body 33' and extends below water flow reversing cap 35' into the bottom of which a guide tube 53 guiding the the mounting guide pin 54 of spring 55 biased to close check valve 56 is threaded 57. The check valve 56 seats in the beveled valve seat opening 58 in the closed state when the jet pump is not pumping. However, when the jet pump 15' is pumping with reverse directed up flow water being pumped at high pressure and high speed through venturi chamber 42 the venturi action created vacuum drawing product fluids through tube 59 (used in place of the check valve 46), providing a continuously open passage between chamber enclosure 52 and venturi chamber 42, is sufficient to open check valve 56 and draw product such as oil and/or gas from the well casing 12 and the well formation pay zone.

Referring now to FIG. 5 circulation water from a water holding tank 60 is passed through an on-off solenoid valve 61 to a positive displacement pump 62 driven by an electric motor 63. Please note that pump 62 could be a centrifrugal or turbine pump in place of a positive displacement pump 62. On-off solenoid valve 61 is controlled from control and power source 64 and hands off automatic control 65 for motor 63 is also controlled from control and power source 64. The pump 62 feeds water flow under pressure through line 66 and through valve fitting 67 to pipe 24 with water pressure gauge 68 indicating water pressure out of pump 62 and gauge 69 indicates water pressure at the valve fitting 67 at the top of pipe 24. The tube 14 is connected via fitting 48 and line 70 with valve 71 and a pressure gauge 72 to a separator 73 shown in FIG. 6 mounted on a pallet 74. The well casing 12 also has a line connection through valve 75 to line 70 in order that product oil and/or gas under pressure in the casing may be fed to the separator 73 in alleviating a condition that exists from time to time. Circulation water is passed from the separator 73 to water tank 60 and oil is passed from the separator via line 76, pump 77 and line 78 to oil storage tank 79.

It should be noted that the pump 62 may be in a system controlled for pumping from a plurality of wells one at a time or selective combinations of wells at any one interval of time.

The graph of FIG. 7 may be used as a guide for pumping system usage with pump water pressure, rate of production flow and horsepower requirement graph plot based on 100% efficiency.

Whereas this invention has been described particularly with respect to several embodiments thereof, it should be realized that various changes may be made without departure from the essential contributions to the art made by the teachings hereof.

I claim:

1. A down the hole reverse up flow jet pump in a system operational with circulation fluids pumped from above the earth surface comprising: an in the well down the the hole up flow jet pump; down flow fluid passage means connected to said jet pump and extending up the hole to the well head at the surface; up flow fluid passage means connected to said jet pump and extending up the hole to the well head at the surface; a jet pump elongate body with down flow fluid passage means extended through said body from top to bottom thereof connected to and forming an extension of said down flow fluid passage means connected to said jet pump and extending up the hole to the well head at the surface; fluid flow reversing means mounted on the bottom of said jet pump elongate body; lowering opening means in said body extending from the bottom of said body to a venturi chamber in said body with said lower opening means narrowing from its bottom to its upper exit opening to said venturi chamber for accelerated fluid flow into and through said venturi chamber; said venturi chamber being of greater transverse cross-sectional area that the upper exit opening of said lower opening means; upper opening means in said body extending from said venturi chamber to the top of said jet pump elongate body with said upper opening means connected to said up flow passage means; and with said jet pump elongate body including venturi transverse inlet side vent means extended from the exterior of said body to said venturi chamber for vacuum effect drawing of well fluids and/or gases from the well casing and a well production zone into the fluid flow stream for passage from the jet pump body to and up said flow fluid passage means to the well head and from the well; and wherein said jet pump elongate body is generally a cylindrical body; said lower opening means in said body is a center opening in the form of a truncated cone narrowing from its larger bottom to its smaller upper exit opening; and with said venturi chamber a centrally located cylindrical chamber.

2. The down the hole reverse up flow jet pump of claim 1, wherein said exit opening is a relatively short, relative to the length of said truncated cone, cylindrical passage of less diameter than the diameter of said venturi chamber; and said cylindrical passage joining the top of said truncated cone and said venturi chamber.

3. The down the hole reverse up flow jet pump of claim 2, wherein said cylindrical passage is shorter than the length of said venturi chamber.

4. The down the hole reverse up flow jet pump of claim 3, wherein said upper opening means in said body extending from said venturi chamber to the top of said jet pump elongate body is in the form of an inverted truncated cone aligned with said venturi chamber and extended from the top of rim of said venturi chamber to a relatively larger outlet opening at the top of said body.

5. The down the hole reverse up flow jet pump of claim 4, wherein said down flow fluid passage means extended through said body is eccentrically positioned in said body so as to not interfere with said lower opening means, said venturi chamber and said upper opening means.

6. The down the hole reverse up flow jet pump of claim 5, wherein said flow reversing means mounted on the bottom of said jet pump elongate body is a fluid flow reversing cap with an upper internal chamber open to both the bottom end of said jet pump body down flow fluid passage means and to the bottom of said lower opening means; and with said upper internal chamber in the cap a smooth curved surface shaped to efficiently reverse the down flow of fluid under pressure issuing from the bottom of said jet pump body down flow fluid passage means and direct the fluid flow inward to and up said lower opening means.

7. The down the hole reverse up flow jet pump of claim 6, wherein said jet pump body down flow fluid passage means is a plurality of passages extended through said body from top to bottom thereof.

8. The down the hole reverse up flow jet pump of claim 7, wherein said down flow fluid passage means connected to said jet pump includes a pipe extending down from the well head to fluid flow interconnect means interconnecting said pipe and the top of said jet pump body down flow fluid passage means.

9. The down the hole reverse up flow jet pump of claim 8, wherein said up flow fluid passage means connected to said jet pump includes a tube string, larger than and enclosing said pipe, extending down from the well head to coupling means connection with the top of said jet pump body.

10. The down the hole reverse up flow jet pump of claim 9, wherein said fluid flow interconnect means includes a two way fluid flow block supported in the bottom of said tube string; said block having an upper opening receiving the bottom end of said pipe; and having a plurality of bottom openings extending from said upper opening to the bottom of said block; and a plurality of fluid flow diverting line tubes with upper ends held in said plurality of bottom openings and lower ends received in the top ends of said plurality of down flow passages in said body.

11. The down the hole reverse up flow jet pump of claim 10, wherein said coupling means interconnecting said tube string and the top of said jet pump body encloses an up flow fluid chamber through which said plurality of fluid flow diverting line tubes extend, and through which fluid flows from said upper opening means in said jet pump elongate body to and up the space between said tube string and said pipe enclosed therein.

12. The down the hole reverse up flow jet pump of claim 11, wherein check valve means is included in the fluid flow stream path that passes through said venturi transverse inlet side vent means with the check valve means oriented to prevent reverse fluid flow and to prevent reverse fluid flow and to prevent imposition of fluid column static pressure in the well casing and on the well production zone from the fluid columns in said down flow fluid passage means connected to said jet pump body and said up flow fluid passage means when circulation fluids are not being pumped from above the earth surface down said flow fluid passage means.

13. The down the hole reverse up flow jet pump of claim 12, wherein said check valve is included within said venturi transverse inlet side vent means.

14. The down the hole reverse up flow jet pump of claim 12, wherein a chamber surrounds the lower portion of the jet pump body from above the venturi transverse inlet side vent means down to below said fluid flow reversing cap; and an opening in the bottom of said chamber so that as fluid is drawn through the venturi transverse inlet side vent means by the venturi suction action of the jet pump fluid is drawn through said opening in the bottom of said chamber from the well casing and the well production zone; and with the check valve at the bottom for closing said opening in the bottom of said chamber to limit head pressure from the well casing when the jet pump is not pumping.

15. The down the hole reverse up flow jet pump of claim 12, wherein a chamber surrounds the lower portion of the jet pump body from above the venturi transverse inlet side vent means down to below said fluid flow reversing cap; and an opening it the bottom of said chamber so that as fluid is drawn through the venturi transverse inlet side vent means by the venturi suction action of the jet pump fluid is drawn in through said opening in the bottom of said chamber from the well casing and the well production zone.

16. The down the hole reverse up flow jet pump of claim 15, wherein a spring loaded check valve is included that seats in said opening in the bottom of said chamber to limit head pressure from the well casing when the jet pump is not pumping.

17. The down the hole reverse up flow jet pump of claim 11, wherein said two way fluid flow block is a vertically lobed block with lobe support projections the bottom outer portions of which rest on a block support internal shoulder in the bottom of said tube string; and with flow channels between the lobes permitting the upward flow of fluids from said up flow fluid chamber in said coupling means.

18. The down the hole reverse up flow jet pump of claim 1, wherein said down flow fluid passage means extended through said body is eccentrically positioned in said body so as not to interfere with said lower opening means, said venturi chamber and said upper opening means.

19. The down the hole reverse up flow jet pump of claim 18, wherein said fluid flow reversing means mounted on the bottom of said jet pump elongate body is a fluid flow reversing cap with an upper internal chamber open to both the bottom end of said jet pump body down flow fluid passage means and to the bottom of said lower opening means; and with said upper internal chamber in the cap a smooth curved surface shaped to efficiently reverse the down flow of fluid under pressure issuing from the bottom of said jet pump body down flow fluid passage means and direct the fluid flow inward to and up said lower opening means.

20. The down the hole reverse up flow jet pump of claim 19, wherein said jet pump body down flow fluid passage means is a plurality of passages extended through said body from top to bottom thereof.

21. The down the hole reverse up flow jet pump of claim 20, wherein said downflow fluid passage means connected to said jet pump includes a pipe extending down from the well head to the fluid flow interconnect means interconnecting said pipe and the top of said jet pump body down flow fluid passage means.

22. The down the hole reverse up flow jet pump of claim 21, wherein said up flow fluid passage means connected to said jet pump includes a tube string, larger than and enclosing said pipe, extending down from the well head to coupling means connected with the top of said jet pump body.

23. The down the hole reverse up flow jet pump of claim 22, wherein said fluid flow interconnect means includes a two way fluid flow block supported in the bottom of said tube string; said block having an upper opening receiving the bottom end of said pipe; and having a plurality of bottom openings extending from said upper opening to the bottom of said block; and a plurality of fluid flow diverting line tubes with upper ends held in said plurality of bottom openings and lower ends received in the top ends of said plurality of down flow passages in said body.

24. The down the hole reverse up flow jet pump of claim 23, wherein said coupling means interconnecting said tube string and the top of said jet pump body encloses an up flow fluid chamber through which said plurality of fluid flow diverting line tubes extend, and through which fluid flows from said upper opening means in said jet pump elongate body to and up the space between said tube string and said pipe enclosed therein.

25. The down the hole reverse up flow jet pump of claim 24, wherein check valve means is included in the fluid flow stream path that passes through said venturi transverse inlet side vent means with the check valve means oriented to prevent reverse fluid flow and to prevent imposition of fluid column static pressure in the well casing and on the well production zone from the fluid columns in said down flow fluid passage means connected to said jet pump body and said up flow fluid passage means when circulation fluids are not being pumped from above the earth surface down said down flow fluid passage means.

26. The down the hole reverse up flow jet pump of claim 25, wherein said check valve is included within said venturi transverse inlet side vent means.

27. The down the hole reverse up flow jet pump of claim 25, wherein a chamber surrounds the lower portion of the jet pump body from above the venturi transverse inlet side vent means down to below said fluid reversing cap; and an opening in the bottom of said chamber so that as fluid is drawn through the venturi transverse inlet side vent means by the venturi suction action of the jet pump fluid is drawn in through said opening in the bottom of said chamber from the well casing and the well production zone; and with the check valve at the bottom for closing said opening in the bottom of said chamber to limit head pressure from the well casing when the jet pump is not pumping.

28. The down the hole reverse up flow jet pump of claim 25, wherein a chamber surrounds the lower portion of the jet pump body from above the venturi transverse inlet side vent means down to below said fluid flow reversing cap; and an opening in the bottom of said chamber so that as fluid is drawn through the venturi transverse inlet side vent means by the venturi suction action of the jet pump fluid is drawn in through said opening in the bottom of said chamber from the well casing and the well production zone.

29. The down the hole reverse up flow jet pump of claim 28, wherein a spring loaded check valve is included that seats in said opening in the bottom of said chamber to limit head pressure from the well casing when the jet pump is not pumping.

30. The down the hole reverse up flow jet pump of claim 24, wherein said two way fluid flow block is a vertically lobed block with lobe support projections the bottom outer portions of which rest on a block support internal shoulder in the bottom of said tube string; and with flow channels between the lobes permitting the upward flow of fluids from said up flow fluid chamber in said coupling means.

* * * * *